United States Patent [19]

Gomi et al.

[11] Patent Number: 4,581,124

[45] Date of Patent: Apr. 8, 1986

[54] PROCESS FOR THERMALLY CRACKING HEAVY HYDROCARBON OIL

[75] Inventors: Shimpei Gomi, Tokyo; Terukatsu Miyauchi, Yokohama, both of Japan

[73] Assignee: Fuji Standard Research Inc., Tokyo, Japan

[21] Appl. No.: 747,710

[22] Filed: Jun. 24, 1985

[30] Foreign Application Priority Data

Jun. 27, 1984 [JP] Japan ..... 59-232431

[51] Int. Cl.[4] ..... C10G 9/16; C10G 9/14; C10G 51/02

[52] U.S. Cl. ..... 208/72; 208/48 R; 208/75; 208/67; 208/39

[58] Field of Search ..... 208/72, 48 R, 75, 67

[56] References Cited

U.S. PATENT DOCUMENTS

| | | | |
|---|---|---|---|
| 2,063,505 | 12/1936 | Huff | 208/72 |
| 2,234,910 | 3/1941 | Barron | 208/75 |
| 2,247,740 | 7/1941 | Angell | 208/75 |
| 3,065,165 | 11/1962 | Amis et al. | 208/48 R |
| 3,928,170 | 12/1975 | Takahashi et al. | 208/128 |
| 4,178,228 | 12/1979 | Chang | 208/72 |
| 4,264,432 | 4/1981 | Gartside | 208/48 R |
| 4,477,334 | 10/1984 | Gomi et al. | 208/72 |
| 4,487,686 | 12/1984 | Gomi et al. | 208/72 |

*Primary Examiner*—Andrew H. Metz
*Assistant Examiner*—Helane Myers
*Attorney, Agent, or Firm*—Pahl, Lorusso & Loud

[57] ABSTRACT

A continuous process for thermally cracking a heavy hydrocarbon oil, including heat-treating the heavy hydrocarbon oil in a first thermal cracking zone for obtaining a first cracked product, and introducing the first cracked product into a second thermal cracking zone where it is thermally cracked by direct contact with a gaseous heat transfer medium to form distillable cracked components and a mesophase-containing pitch. The liquid phase in the second thermal cracking zone, including the mesophase-containing pitch, is withdrawn therefrom and separated into a mesophase-rich pitch and a matrix pitch having a low concentration of mesophase. The matrix pitch is recycled to the second thermal cracking zone. The distillable cracked components are stripped from the liquid phase in the second thermal cracking zone with the heat transfer medium, and the resulting gas phase is discharged overhead therefrom and then separated into a light fraction and a heavy fraction. The heavy fraction is fed to a third thermal cracking zone to obtain light oil components and an aromatic tar. The aromatic tar is recycled to the second thermal cracking zone.

8 Claims, 1 Drawing Figure

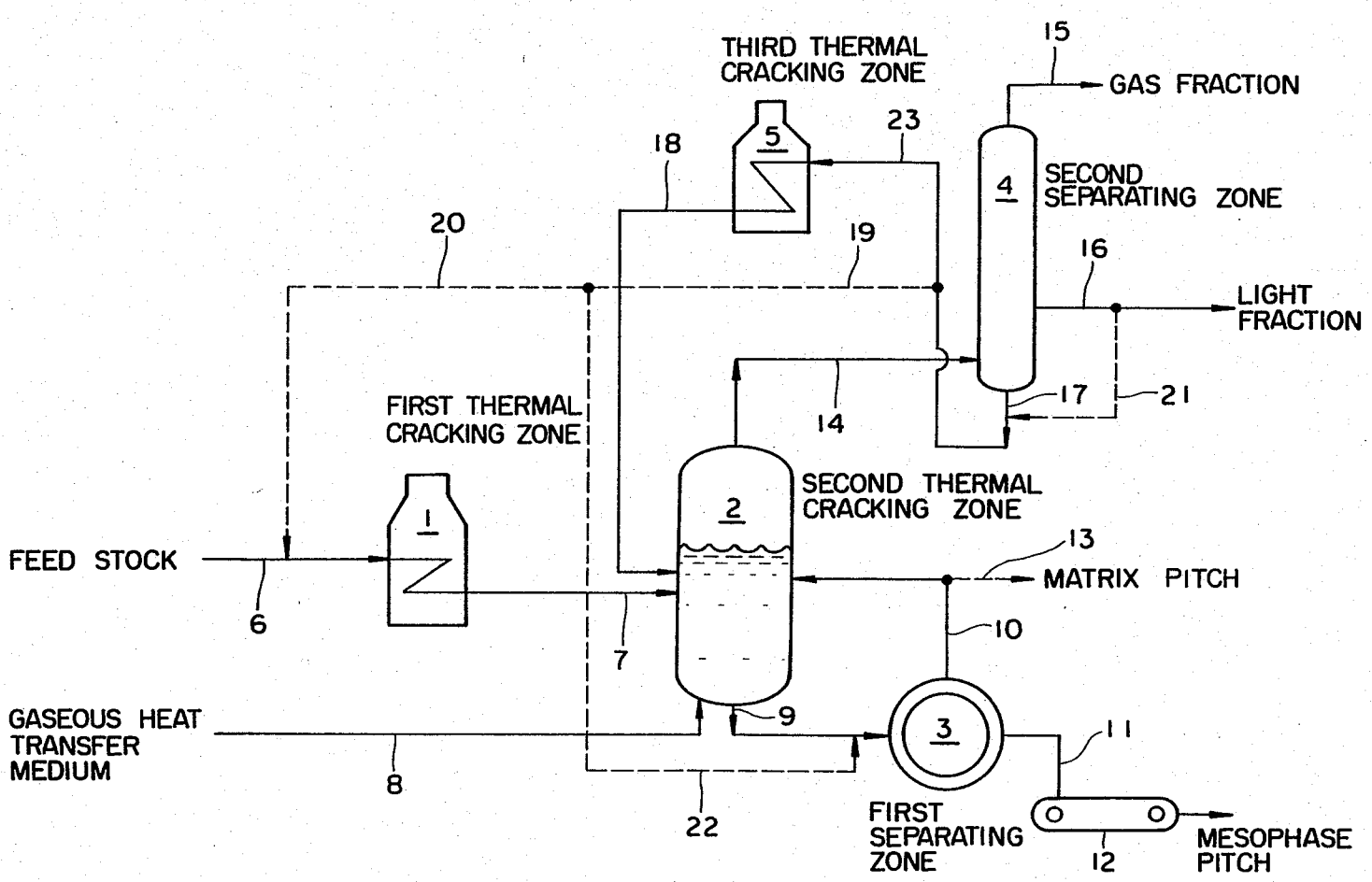
GAS FRACTION
SECOND SEPARATING ZONE
LIGHT FRACTION
MESOPHASE PITCH
MATRIX PITCH
THIRD THERMAL CRACKING ZONE
SECOND THERMAL CRACKING ZONE
FIRST SEPARATING ZONE
FIRST THERMAL CRACKING ZONE
FEED STOCK
GASEOUS HEAT TRANSFER MEDIUM
1
2
3
4
5
6
7
8
9
10
11
12
13
14
15
16
17
18
19
20
21
22
23

PROCESS FOR THERMALLY CRACKING HEAVY HYDROCARBON OIL

This invention relates to a process for continuously thermally cracking a heavy hydrocarbon oil.

A variety of thermal cracking processes for obtaining cracked oils and coke or pitch from heavy hydrocarbon oils have been hitherto proposed and some of them have been actually industrially utilized. In thermal cracking of heavy hydrocarbon oils, it is extremely difficult to avoid the occurrence of coking. Therefore, a batch system, a semibatch system or a modified system thereof is generally adopted in such thermal cracking treatment.

For example, in a delayed coker method which is operated in a batch system, when coke is accumulated within the reactor in a predetermined amount, the reaction is unavoidably stopped. While the delayed coker method can produce a light oil product such as gasoline with a relatively high yield, the coke thus produced generally has a volatile matter content of about 10% and, therefore, is illsuited for use as a solid fuel.

Although a Eureka process, such as disclosed in U.S. Pat. No. 3,928,170, in which a gaseous heat transfer medium is brought into direct contact with a heavy hydrocarbon oil for effecting the thermal cracking thereof under relatively mild conditions and for stripping volatile cracked products, is operated, as a whole, in a continuous manner, the thermal cracking is performed in a semibatch mode. While the Eureka process can produce a pitch with a high aromatic content and useful as a binder for the production of coke, the cracked oil product has a relatively large amount of heavy hydrocarbon components and, therefore, the Eureka process is not advantageously adopted for the production of light hydrocarbon oils. Japanese Examined Patent Publication No. 57-15796 suggests a continuous Eureka process. However, the process requires the use of a plurality of thermal cracking reactors connected in series for controlling the residence time of the reaction solution.

In accordance with the present invention, there is provided a process for continuously thermally cracking a heavy hydrocarbon oil, comprising the steps of:

(a) feeding the heavy hydrocarbon oil into a first thermal cracking zone for thermally cracking the heavy hydrocarbon oil and for obtaining a first, thermally cracked product;

(b) introducing the first product into a second thermal cracking zone to which a gaseous heat transfer medium is supplied for direct contact with the liquid phase in the second thermal cracking zone, including the first product, so that the first product is further thermally cracked to form a second, thermally cracked product including distillable cracked components and a mesophase-containing pitch forming a part of the liquid phase, said distillable cracked components being stripped with the gaseous heat transfer medium from the liquid phase;

(c) discharging said liquid phase from the second thermal cracking zone and introducing same into a first separating zone for separating the liquid phase into a mesophase rich pitch having a higher concentration of mesophase than the liquid phase and a matrix pitch having a lower concentration of mesophase than the liquid phase;

(d) recycling at least a part of said matrix pitch to said second thermal cracking zone;

(e) removing said stripped, distillable cracked components overhead from said second cracking zone and introducing same into a second separating zone for separating same into a light fraction and a heavy fraction;

(f) introducing at least a part of said heavy fraction into a third thermal cracking zone for thermally cracking same and for obtaining a third, thermally cracked product including light oil components and an aromatic tar; and (g) recycling the aromatic tar to said second cracking zone.

The process of the present invention will now be described in detail below.

1. First Thermal Cracking Step

Any heavy hydrocarbon oils may be used as a feed stock for the thermal cracking treatment according to the process of the present invention so far as they can give a pitch. Examples of the heavy hydrocarbon oil include heavy petroleum fractions such as atmospheric residues, vacuum residues and cracked residues and other heavy hydrocarbon products such as asphalt products from solvent deasphalting processes, native natural asphalt, heavy liquified coal oils and mixtures of the above. The heavy hydrocarbon oil containing a large amount of heavy metals may be used in the present invention. If desired, metal compounds may be added to the heavy hydrocarbon oil for the purpose of accelerating the formation of mesophase and of improving the separability of the mesophase from the matrix pitch.

The heavy hydrocarbon oil is fed to a first thermal cracking zone for thermally cracking same and for obtaining a first, thermally cracked product. The heavy hydrocarbon oil is preferably preheated to a temperature not higher than 350° C. before it is fed to the first cracking zone. Preferably, the first cracking zone is a cracking furnace provided with a tubular reactor through which the heavy hydrocarbon oil is streamed to undergo the thermal cracking. The thermal cracking in the first cracking zone is preferably performed at a temperature between 450° and 510° C., more preferably between 480° and 500° C., and a pressure of from normal pressure to 30 $Kg/cm^2G$, more preferably at a pressure in the outlet port of the cracking zone of between 1 and 5 $Kg/cm^2G$ for a period of time between 0.3 and 30 min, more preferably between 3 and 20 min, while substantially preventing the occurrence of coking. In order to prevent coking from occurring in the first cracking zone, it is preferred that a portion of a heavy fraction which is obtained in the fractionating step described hereinafter be introduced into the first cracking zone in an amount of between 20 and 30% based on the weight of the heavy hydrocarbon oil feed. It is also advisable to add water to the hydrocarbon oil in an amount of between 0.3 and 3% based on the weight of the heavy hydrocarbon feed for the purpose of increasing the linear velocity of the heavy hydrocarbon oil streamed through the tubular reactor and thereby preventing the occurrence of coking. The thermal cracking in the first cracking zone is preferably carried out so that 10–50% by weight, more preferably 20–40% by weight of the heavy hydrocarbon oil is converted into the first, thermally cracked product.

2. Second Thermal Cracking Step

The first, thermally cracked product obtained in the first thermal cracking step is continuously fed to a second thermal cracking zone where it is contacted with a gaseous heat transfer medium to further thermally crack the first product and to form a second, thermally cracked product including a distillable cracked components and a mesophase-containing pitch which forms a liquid phase in the second thermal cracking zone. The distillable cracked components are stripped from the liquid phase with the gaseous heat transfer medium.

The second thermal cracking zone is a continuous-type reactor preferably equipped with an agitator. The reactor is provided with a feed port through which the first cracked product from the first cracking zone is supplied thereto, an inlet port through which an aromatic tar obtained in a third cracking zone described hereinafter is supplied thereto, a withdrawing port through which the distillable cracked components are removed therefrom together with the gaseous heat transfer medium, a discharge port through which the liquid phase is discharged therefrom, a recycling port through which a matrix pitch obtained from the liquid phase in a separating zone described hereinafter is recycled thereto and an injecting port through which the gaseous heat transfer medium is supplied thereto for contact with the liquid phase contained therein.

Thus, in the second cracking zone, the liquid phase including the first product from the first cracking zone, the aromatic tar from the third cracking zone and the matrix pitch from the separating zone is contacted with the heat transfer medium so that its distillable components are stripped and withdrawn overhead from the second cracking zone. At the same time, the liquid phase is subjected to thermal cracking conditions by direct heat exchange with the heat transfer medium, thereby to form distillable cracked components (cracked light oil and cracked gas) and a pitch due to the polycondensation and aromatization reactions inherent to the thermal cracking. The distillable cracked components thus formed are stripped with the heat transfer medium from the liquid phase and removed from the second cracking zone together with the heat transfer medium. The thermal cracking in the second thermal cracking zone is carried out so that a substantial amount, preferably 5–25% by weight based on the liquid phase, of mesophase, preferably having a weight average particle diameter of 30–200 $\mu$, is formed. The mesophase is homogeneously dispersed in the liquid phase (pitch phase) in the second cracking zone.

In order to form the pitch in which the mesophase is homogeneously dispersed, it is important that the distillable cracked components should be stripped from the pitch phase (liquid phase). If the thermal cracking is performed in the presence of a large amount of the volatile comonents, the mesophase will grow large and coalesce with each other and coking will be apt to occur. By controlling the thermal cracking temperature and the partial pressure of gas phase (i.e. the total partial pressure of the cracked gas and the oil vapor in the heat transfer medium), the pitch phase in which the mesophase with suitable properties, concentration and size is homogeneously dispersed may be produced, whereby the separation of the pitch phase into a matrix pitch and a mesophase rich pitch as hereinafter described may be effectively performed.

The thermal cracking conditions in the second cracking zone vary with the properties of the first cracked product fed from the first cracking zone. Generally, the thermal cracking in the second cracking zone is performed at a temperature of 410°–460° C., preferably 430°–450° C., a partial pressure of the gas phase of 60–500 mmHg, preferably 150–350 mmHg, with a residence time of the liquid phase in the second cracking zone of 2–60 min, preferably 5–30 min. The pressure within the second cracking zone is preferably from normal pressure to 0.5 kg/cm$^2$G. A reduced pressure may be adopted, if desired. Generally, by increasing the temperature of the liquid phase in the second thermal cracking zone, the residence time of the liquid phase can be shortened and the aromaticity of the pitch produced becomes high. By decreasing the partial pressure of the gas phase, on the other hand, the yield of the mesophase is decreased, the size of the mesophase becomes small, the homogeneity in dispersion of the mesophase in the liquid phase is improved and the residence time of the liquid phase may be shortened.

The gaseous heat transfer medium is preferably a substantially oxygen-free, non-oxidative gas such as steam, a hydrocarbon gas, a perfect combustion waste gas or an inert gas such as nitrogen or argon and has generally a high temperature, preferably of 400°–800° C. Since the heat required for effecting the second thermal cracking step is mainly supplied from the products obtained in the first and third thermal cracking zones, the temperature of the gaseous heat transfer medium need not be very high.

For the purpose of preventing coking from occurring on the inside wall of the second thermal cracking reactor at a portion higher than the level of the liquid phase, that portion of the reactor may be cooled by direct or indirect contact with cooling water. Alternately, to achieve this purpose, the matrix pitch to be recycled to the second cracking step may be introduced in such a manner as to travel on the inside wall of the reactor and to continually wet and wash the surface thereof. In either case, it is preferred that the temperature in the upper space of the liquid phase be 30°–60° C. lower than that of the liquid phase.

3. Separation of Liquid Phase

A portion of the liquid phase in the second cracking zone is continuously discharged therefrom and is introduced into a first separating zone where the liquid phase is separated into a matrix pitch and a mesophase rich pitch such that the concentration of the mesophase is decreased in the matrix pitch and is increased in the mesophase rich pitch as compared with the liquid phase. At least a portion of the matrix pitch is recycled to the second cracking zone, as described previously, for controlling the concentration of mesophase in the liquid phase in the second cracking zone and for thereby preventing the occurrence of coking. Thus, the recycling of the matrix pitch makes it possible to continuously perform the second thermal cracking step. The mesophase rich pitch is recovered as a pitch product. Preferably, the mesophase rich pitch has a mesophase content of at least 30% by weight, more preferably at least 50% by weight. If desired, a portion of the matrix pitch may be also recovered as a product. The matrix pitch product may be used, for example, as a precursor pitch for the production of carbon fibers after the removal of its mesophase by means of, for example, a filtering device.

The separation of the liquid phase into the matrix pitch and the mesophase rich pitch may be effected by any known methods generally utilized for liquid-solid separation, such as sedimentation, filtrating, centrifuge, a method using a liquid cyclone device, a method utilizing the difference in physical properties, such as solubility, between the mesophase rich pitch and matrix pitch, such as a solvent extraction method or a supercritical fluid extraction method, or a combination of the above methods. The separation may be effected in a single or multiple stage process. A combination of a rotary filtering device with a liquid cyclone or a sedimentation vessel having a scraper may give very satisfactory results and is a preferred separation method.

It is advisable to reduce the residence time in the separation zone. The temperature at which the separation of the liquid phase is performed varies with the kind and the properties of the pitch to be treated and the properties of the mesophase rich pitch product. Generally the separation is performed at a temperature of 200°-460° C., preferably 200°-400° C. If, in the separation step, the liquid phase is subjected to a high temperature for a long period of time, there is danger that the reactions resulting in the formation of pitch proceed and coking troubles are liable to occur. Too low a separation temperature will cause the increase of the viscosity of the liquid phase, resulting in the reduction in separating efficiency. In the case of the separation by means of a liquid cyclone in combination with a rotary filtering device, for example, the liquid phase in the cyclone is maintained at a temperature about 5° to 20° C. lower than the reaction temperature in the second thermal cracking zone, cooled during its passage through intermediate vessels (such as stabilizer) and maintained at about 280°-320° C. in the rotary filtering device.

If desired, a portion of the heavy fraction and/or light fraction obtained in the fractionating step (second separating zone) described hereinafter may be fed to the first separating zone. By this, the viscosity and the temperature of the liquid phase to be treated may be lowered and, therefore, the separation may be efficiently conducted without encountering coking problems.

4. Separation of Distillable Cracked Components

The distillable cracked components (cracked gas and light oil) in the second cracking zone are removed overhead therefrom together with the gaseous heat transfer medium and are fed to a second separating zone, generally a distillation tower, where they are separated into a heavy fraction, for example, with a boiling point of above 370° C., a light fraction, for example, with a boiling point of below 370° C. and a gas fraction. The light fraction and gas fraction are recovered as products. At least a portion of the heavy fraction is supplied to a third thermal cracking zone described hereinafter. As described previously, a portion of the heavy fraction may be fed to the first thermal cracking zone and another portion of the heavy fraction may be fed to the first separating zone.

5. Third Thermal Cracking Step

The heavy fraction supplied from the second separating zone is subjected to thermal cracking conditions in the third thermal cracking zone, whereby the heavy fraction is converted into light oil components and an aromatic tar.

The third thermal cracking zone may be conventional tubular reactor disposed within a furnace. Since the heavy fraction has once experienced thermal hysteresis and is slow in cracking rate, the third thermal cracking step is generally performed at a temperature higher than the temperature at which the second thermal cracking is performed. The third thermal cracking step is generally performed at a temperature of 450°-520° C., preferably 480°-510° C., a pressure of 0.1-50 kg/cm$^2$G, preferably a pressure at the outlet of the third cracking zone of 2-5 kg/cm$^2$G, for a period of 0.5-30 min, preferably 3-20 min. The aromatic tar thus produced is then fed either by itself or together with the light oil components to the second thermal cracking zone, preferably into the liquid phase in the second thermal cracking zone. When the aromatic tar alone is introduced into the second thermal cracking zone, the product in the third cracking zone is first fed to a separating zone, such as a flush separator, for the separation of the tar from the light oil components.

By introducing the aromatic tar into the second thermal cracking zone, the occurrence of coking in the second cracking zone is effectively prevented. That is, the tar having a high content of aromatic components serves to function as a solvent so that the aggromeration and growth of coke precursors are effectively prevented, enabling the thermal cracking in the second cracking zone to be operated continuously.

The process according to the present invention is thus conducted in a fully continuous mode. Further, the main thermal cracking (second cracking step) is effected in a single reactor at a high temperature with a short average residence time and under a condition so that the distribution of the residence time in the reactor is concentrated in a narrow range. As a concequence, the thermal cracking may be conducted at a high cracking rate while preventing the occurrence of coking and with a high yield of cracked light oil and the molecular weight distribution of the pitch product (mesophase rich pitch and the matrix pitch) is concentrated to a narrow range. The process of the present invention has an additional advantage that the softening point of the pitch product may be controlled. For example, it is possible to obtain a mesophase rich pitch containing 30-100% by weight of mesophase and having a softening point of 220°-350° C. and a volatile matter content of 15% by weight or more, generally 20-35% by weight while obtaining a matrix pitch containing only a small amount of mesophase and having a softening point of 120°-250° C. and a volatile matter content of 35% by weight or more. By removing the residual mesophase in the matrix pitch, a substantially isotropic pitch may be obtained.

In the process of the present invention, the liquid phase in the second cracking zone is continuously withdrawn therefrom and the matrix pitch with a decreased meosphase content is recycled thereto. Therefore, the content of the mesophase in the liquid phase in the second cracking zone can be maintained at a low level so that the occurrence of coking troubles may be prevented. Further, because of the recirculation of the matrix pitch, the problem involved in the conventional continuous process that a part of the feed material to be treated is discharged without undergoing thermal cracking may be overcome.

One preferred embodiment according to the present invention will now be described with reference to the accompanying drawing, in which:

the sole FIGURE is a flowdiagram illustrating an apparatus for carrying out the process of the present invention.

The reference numeral 1 designates a first cracking zone, generally a tubular thermal cracking reactor disposed within a furnace, to which a heavy hydrocarbon feed stock is, preferably after being preheated, continuously fed through a line 6 for undergoing thermal cracking. The first product obtained in the reactor 1 is then passed to a second cracking zone, generally a cylindrical reactor 2, through a line 7. A gaseous heat transfer medium is continuously supplied through a line 8 to the reactor 2 for direct contact with the liquid phase in the reactor 2 including the first product from the reactor 1. The heat transfer medium serves to stir the liquid phase in the reactor 2, to maintain the temperature of the liquid phase within a predetermined range, and to strip distillable cracked components from the liquid phase. In the reactor 2, the first product is thus subjected to thermal cracking, thereby to form pitch and mesophase homogeneously dispersed in the liquid phase (pitch phase).

The distillable cracked components stripped from the liquid phase are withdrawn overhead from the second reactor 2 and fed to a second separating zone 4 through a line 14 together with the gaseous heat transfer medium. The liquid phase is continuously discharged from the second reactor 2 through a line 9 while maintaining the liquid level of the liquid phase in the reactor 2 at a predetermined level. The liquid phase discharged from the reactor 2 is passed to a first separating zone, preferably a combination of a sedimentation vessel having a scraper and a filtering device 3, where it is separated into a mesophase rich pitch and a matrix pitch. The mesophase rich pitch is fed through a line 11 to a flaker 12 where it is solidified for recovery as a product. The matrix pitch is recycled through a line 10 to the reactor 2 for undergoing a further thermal cracking treatment. If desired, a portion of the matrix pitch is diverted from the line 10 through a line 13 for recovery.

The distillable cracked components introduced into the second separating zone 4, generally a distillation tower, are fractionated into a cracked gas fraction, a light fraction and a heavy fraction. The gas fraction is withdrawn through a line 15 and, if desired, supplied to a succeeding fractionating tower (not shown) for the separation of light oil components. The light fraction, for example a fraction with a boiling point of 370°–538° C., is recovered through a line 16 while the heavy fraction, for example a residual fraction with a boiling point of 538° C. or more, is discharged from the bottom of the tower 4 through a line 17 for recycling to the second cracking zone 2 after being subjected to a further thermal cracking treatment in a third thermal cracking zone 5.

The heavy fraction discharged through the line 17 is thus fed through a line 23 to the third cracking zone 5. If desired, a portion of the light fraction may be mixed into the heavy fraction through a line 21. A portion of the heavy fraction, optionally containing the light fraction, may be, if desired, diverted from the line 23 and introduced through lines 19 and 22 into the line 9 for diluting and cooling the liquid phase to be introduced into the first separating zone 3 and for preventing the occurrence of coking in the separating zone 3. Further, another portion of the heavy fraction, optionally containing the light fraction, may also be fed through the line 19 and a line 20 to the first cracking zone 1 for preventing the occurrence of coking in the zone 1, if desired.

In the third cracking zone 5, generally a tubular reactor disposed within a furnace, the heavy fraction is thermally cracked to form light oil components and aromatic tar, which are recycled through a line 18 to the second cracking zone 2, preferably into the liquid phase in the zone 2. If desired, the light oil components and aromatic tar are first fed to a gas-liquid separator, such as a flush separator (not shown), where they are separated from each other. The aromatic tar thus separated is then fed by itself to the second cracking zone 2 while the light oil components are recycled to the distillation tower 4.

The following examples will further illustrate the present invention.

EXAMPLE 1

A vacuum residue from a mixed crude oil composed of a Middle East crude and a Venezuelan crude was used as a feed stock for the thermal cracking treatment according to the present invention. The feed stock had a specific gravity (15°/4° C.) of 1.0276, a Conradson carbon residue of 23.1 wt %, a sulfur content of 3.9 wt % and an ash content of 0.2 wt %. The feed stock was continuously fed at a feed rate of 100 kg/hr to an external heat-type tubular reactor (first thermal cracking zone), where it was thermally cracked at a temperature of 490° C., a pressure of 2 kg/cm$^2$G for 0.5 min. The resulting first product was fed to a perfect mixing-type cylindrical reaction vessel (second thermal cracking zone) having an inside volume of 150 liters and equipped with a stirrer and a scraper. A high temperature steam (700° C.) was continuously supplied from the bottom of the reaction vessel at a controlled rate so that the thermal cracking of the first product was carried out at a temperature of 445° C. with a partial pressure of the cracked product in the gas phase of 200 mmHg. As described hereinafter, a third thermal cracking product obtained in a third cracking zone and containing an aromatic tar was also supplied to the reaction vessel at a feed rate of 20 kg/hr.

A small amount of water was sprayed in the open space above the liquid level in the reaction vessel for maintaining the temperature of the gas phase at about 400° C., which is lower than that of the liquid phase, and for refluxing a part of the cracked oil thereby preventing the foaming of the liquid level and the coking at the inside wall of the reaction vessel.

The liquid phase within the reaction vessel was sufficiently stirred to maintain the mesophase particles formed as a result of the thermal cracking in a homogeneously dispersed state.

The liquid phase in the reaction vessel was continuously discharged therefrom at a rate of 160 kg/hr and fed to a sedimentation vessel-type separator where it was separated by gravity and centrifugal force into a relatively mesophase rich pitch containing about 20% of mesophase and a relatively mesophase-deficient pitch containing about 8% of mesophase. The latter pitch was recycled to the reaction vessel at a rate of 100 kg/hr while the former pitch was introduced into an adjusting tank having an inside volume of 50 liters and equipped with a scraper, where it was mixed with water and a heavy fraction fed at a feed rate of 6 kg/hr. As a consequence, the pitch in the adjusting tank was cooled to 330° C. and was decreased in its viscosity. The pitch in the adjusting tank was supplied at a rate of 66 kg/hr to a rotary filtering device, where it was further separated into a matrix pitch containing about 3% of mesophase and a mesophase rich pitch containing about 50% of mesophase. The matrix pitch was recycled at a rate of 40 kg/hr to the reaction vessel while the mesophase rich pitch was recovered at a rate of 26 kg/hr. The mesophase rich pitch had a softening point of 280° C. and a volatile matter content of 22 wt %.

The term "softening point" used herein is determined from a graph which shows the manner in which the pitch sample is softened when one gram of the pitch sample is heated at a rate of 6° C./min under a load of 10 kg/cm$^2$ by means of a koka type flow tester (manufactured by Shimadzu Seisakusho Co., Ltd., Japan).

The term "mesophase content" used herein is measured in the following manner: A mesophase pitch obtained is cooled under a predetermined condition to obtain a solidified mesophase pitch sample. The pitch sample is embedded in a resin (Resin #101 manufactured by Marumoto Industries Co., Ltd., Japan) for fixation of the pitch in the conventional manner. The sample is then polished by means of an automatic optical polisher (manufactured by Marutoh Inc., Japan) until the surface of the pitch becomes mirror suitable for a photomicrographic analysis. A polarized light photomicrograph at a magnification of 100× of the polished pitch sample is taken for the determination of its mesophase content in terms of the area (%) of the optically anisotropic domains.

The overhead product obtained in the reaction vessel was continuously passed to a distillation tower at a rate of 100 kg/hr, where it was separated into a light fraction having a boiling point of 370° C. or less, a heavy fraction having a boiling point of 370°–538° C. and a bottom fraction having a boiling point of 538° C. or more. The light fraction (containing a gas fraction), heavy fraction), heavy fraction and bottom fraction were obtained at rates of 41 kg/hr, 49 kg/hr and 10 kg/hr, respectively. The entire amount of the light fraction and 33 kg/hr of the heavy fraction were recovered as products, respectively. The remaining 16 kg/hr of the heavy fraction was mixed with the bottom fraction (10 kg/hr). A portion (20 kg/hr) of the mixture was fed to a third thermal cracking zone with the remainder (6 kg/hr) of the mixture being fed to the mesophase-separating step as described previously.

The thermal cracking in the third thermal cracking zone was performed at a temperature (at an outlet port of the third thermal cracking zone) of 490° C. and a pressure of 2 kg/cm$^2$G with a mean residence time of 3 min. The resulting cracked product was recycled as such to the reaction vessel as described previously.

The overall yields of respective cracked products are shown in Table 1.

TABLE 1

| Feed stock | 100 kg/hr |
|---|---|
| Cracked gas ($C_4$−) | 7 |
| Naphtha ($C_5$+ to bp 150° C.) | 6 |
| Kerosene (bp 150–370° C.) | 28 |
| Light oil (bp 370–538° C.) | 33 |
| Mesophase pitch | 26 |

As will be appreciated from the foregoing, the thermal cracking process according to the present invention can continuously convert a heavy hydrocarbon oil into mesophase pitch and light hydrocarbon oil with a high yield. By recycling both the matrix pitch which is separated from the liquid phase in the reaction vessel and the tar-containing product which is derived from the distillable components formed in the reaction vessel, to the reaction vessel, the mesophase concentration in the liquid phase in the reaction vessel is maintained at a low level (about 15 weight % in the specific example shown above) and the size of the mesophase is controlled to be small (about 50μ in terms of a weight average particle diameter in the specific example shown above). As a consequence, the thermal cracking in the reaction vessel (second thermal cracking step) can be conducted continuously without encountering coking troubles.

EXAMPLE 2

The heavy hydrocarbon feed stock (100 kg/hr) as used in Example 1 was subjected to a thermal cracking treatment in the same manner as described in Example 1 except that the liquid phase in the reaction vessel (second thermal cracking zone) was discharged at a rate of 260 kg/hr (thus the average dwell time in the reaction vessel was shortened) and a portion of the matrix pitch separated therefrom was recovered as a pitch product.

The liquid phase was introduced into a sedimentation vessel-type separator where it was separated into a relatively mesophase-rich pitch containing about 10% of mesophase and a relatively mesophase-deficient pitch containing about 2.5% of mesophase. The latter pitch was recycled to the reaction vessel at a rate of 200 kg/hr while the former pitch was introduced into an adjusting tank where it was cooled to 400° C. with a small amount of water. The pitch was then separated by a rotary filtering device into a matrix pitch containing almost no mesophase and a mesophase pitch containing about 55% of mesophase. The matrix pitch was obtained at a rate of 49 kg/hr. A portion (35 kg/hr) of the matrix pitch was recycled to the reaction vessel with the remainder portion (14 kg/hr) thereof being recovered as a pitch product. The mesophase rich pitch was obtained at a rate of 11 kg/hr and recovered as a product. The matrix pitch product had a softening point of 185° C., a n-heptane-isoluble content of 80 wt %, a n-heptane-soluble content of 20 wt % and a quinoline-insoluble content of 0.2 wt % and was suitably used as a binder pitch. The mesophase pitch product had a softening point of 250° C. and a volatile matter content of 26 wt %.

The overhead product obtained in the reaction vessel was supplied to the distillation tower at a rate of 95 kg/hr where it was fractionated in the same manner as that of Example 1, whereby a light fraction (inclusive of cracked gas) with a boiling point of 370° C. or less was obtained at a rate of 42 kg/hr, a heavy fraction with a boiling point of 370°–538° C. was obtained at a rate of 45 kg/hr and a bottom fraction with a boiling point of 538° C. or more was obtained at a rate of 8 kg/hr. The bottom fraction (8 kg/hr) was mixed with 12 kg/hr of the heavy fraction and the resulting mixture was fed to the third thermal cracking zone. The remainder portion (33 kg/hr) of the heavy fraction and the light fraction were recovered as cracked products. The third thermal cracking zone was operated in the same manner as in Example 1 to obtain a third product containing aromatic tar and light oil components, which was recycled to the reaction vessel in the same manner as in Example 1. No coking problems were involved in the above cracking treatment and the process was able to be conducted in a fully continuous manner. The overall yields of the cracked products were as shown in Table 2.

TABLE 2

| Feed stock | 100 kg/hr |
|---|---|
| Cracked gas ($C_4-$) | 8 |
| Naphtha ($C_5+$ to bp 150° C.) | 7 |
| Kerosene (bp 150–370° C.) | 27 |
| Light oil (bp 370–538° C.) | 33 |
| Matrix pitch | 14 |
| Mesophase pitch | 11 |

We claim:

1. A process for continuously thermally cracking a heavy hydrocarbon oil, comprising the steps of:

(a) feeding the heavy hydrocarbon oil into a first thermal cracking zone for thermally cracking the heavy hydrocarbon oil and for obtaining a first, thermally cracked product;

(b) introducing the first product into a second thermal cracking zone to which a gaseous heat transfer medium is supplied for direct contact with the liquid phase in the second thermal cracking zone, including the first product, so that the first product is further thermally cracked to form a second, thermally cracked product including distillable cracked components and a mesophase-containing pitch forming a part of the liquid phase, said distillable cracked components being stripped with the gaseous heat transfer medium from the liquid phase;

(c) discharging said liquid phase from the second thermal cracking zone and introducing same into a first separating zone for separating the liquid phase into a mesophase rich pitch having a higher concentration of mesophase than the liquid phase and a matrix pitch having a lower concentration of mesophase than the liquid phase;

(d) recycling at least a part of said matrix pitch to said second thermal cracking zone;

(e) removing said stripped, distillable cracked components overhead from said second cracking zone and introducing same into a second separating zone for separating same into a light fraction and a heavy fraction;

(f) introducing at least a part of said heavy fraction into a third thermal cracking zone for thermally cracking same and for obtaining a third, thermally cracked product including light oil components and an aromatic tar; and (g) recycling the aromatic tar to said second cracking zone.

2. A process as claimed in claim 1, further comprising recovering said mesophase rich pitch obtained in step (c).

3. A process as claimed in claim 1, further comprising recovering a portion of said matrix pitch obtained in step (c).

4. A process as claimed in claim 1, further comprising recovering at least a part of the light fraction obtained in step (e).

5. A process as claimed in claim 1, further comprising recycling a portion of said heavy fraction obtained in step (e) to said first cracking zone.

6. A process as claimed in claim 1, further comprising recycling a portion of said heavy fraction obtained in step (e) to said first separating zone.

7. A process as claimed in claim 1, wherein the aromatic tar is recycled to said second cracking zone together with the light oil components.

8. A process as claimed in claim 1, further comprising separating the third product into the aromatic tar and the light oil components, the aromatic tar thus separated being fed to said second thermal cracking zone and the light oil components thus separated being fed to said second separating zone.

* * * * *